US006257284B1

(12) United States Patent
Schuster

(10) Patent No.: US 6,257,284 B1
(45) Date of Patent: Jul. 10, 2001

(54) WOOF YARN TENSION DEVICE FOR WEAVING MACHINES AND METHOD OF OPERATING SAME

(75) Inventor: Rainer Schuster, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/578,444

(22) Filed: May 26, 2000

(30) Foreign Application Priority Data

May 27, 1999 (DE) ..... 299 09 242

(51) Int. Cl.[7] ..... D03D 47/34
(52) U.S. Cl. ..... 139/194; 66/163
(58) Field of Search ..... 66/163; 139/194

(56) References Cited

U.S. PATENT DOCUMENTS

| | | | | |
|---|---|---|---|---|
| 4,110,654 | | 8/1978 | Paul | 310/323 |
| 4,362,189 | * | 12/1982 | Brouwer et al. | 139/370.2 |
| 4,381,803 | * | 5/1983 | Weidmann et al. | 139/370.2 |
| 4,410,803 | * | 10/1983 | Henze | 112/273 |
| 4,641,688 | | 2/1987 | Gehring | 139/450 |
| 4,814,633 | * | 3/1989 | Tholander | 28/188 |
| 4,924,917 | | 5/1990 | Shaw | 139/452 |
| 5,144,988 | | 9/1992 | Del Favero | 139/452 |
| 5,424,557 | | 6/1995 | Rydborn | 250/561 |
| 5,476,122 | * | 12/1995 | Schuster et al. | 139/194 |
| 5,575,313 | * | 11/1996 | Weber et al. | 139/28 |
| 5,725,029 | | 3/1998 | Loehr et al. | 139/453 |

FOREIGN PATENT DOCUMENTS

| | | |
|---|---|---|
| 34 46 567 | 5/1986 | (DE) . |
| 195 35 895 | 6/1996 | (DE) . |
| 0 333 302 | 9/1989 | (EP) . |
| 0 459 322 | 12/1991 | (EP) . |
| 0 634 509 | 1/1995 | (EP) . |
| 2 568 595 | 2/1986 | (FR) . |

* cited by examiner

*Primary Examiner*—Andy Falik
(74) *Attorney, Agent, or Firm*—Crowell & Moring, L.L.P.

(57) ABSTRACT

A woof yarn tension device for weaving machines, has a controllable tension device which acts upon the woof yarn and which, at least on the output side, has a yarn guide eye. In order to reduce the stressing of the woof yarn, the number of the deflection points for the woof yarn existing on the feeding side are reduced in that the yarn guide eye of the woof yarn tension device is simultaneously constructed as a woof yarn monitor.

9 Claims, 1 Drawing Sheet

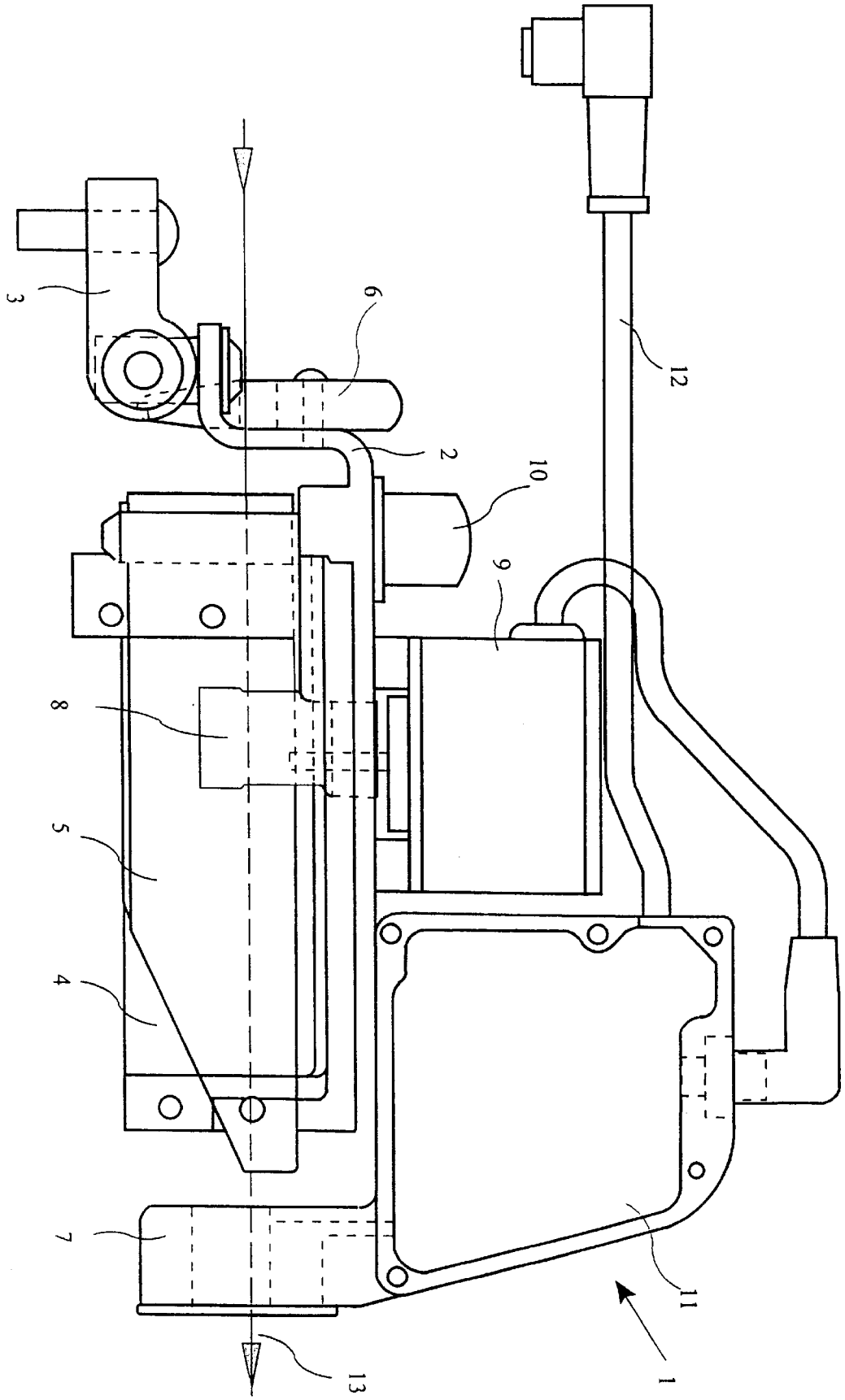
12
11
1
13
10
9
2
6
3
8
5
4
7

WOOF YARN TENSION DEVICE FOR WEAVING MACHINES AND METHOD OF OPERATING SAME

BACKGROUND AND SUMMARY OF INVENTION

This application claims the priority of German patent document 2990942.9, filed May 27, 1999, the disclosure of which is expressly incorporated by reference herein.

The invention relates to a woof yarn tension device for weaving machines.

German Patent Document DE 34 46 567 C1 discloses a woof yarn tension device with a controllable tensioning effect which consists of two lamella-type parts which are resiliently disposed with respect to one another and receive the woof yarn between one another, guide eyes being arranged at the respective input and output of the woof yarn tension device, which guide eyes, also when the tension device is opened up, represent a constant stress to the woof yarn as the result of friction and deflection. A plurality of other types of yarn tension devices are known, for example, having a tension band and a controllable tension body, between which the woof yarn is guided, or so-called wrap tension devices, in the case of which the tensioning force can be adjusted by changing the angle of wrap.

Woof yarn tension devices of this type are part of an arrangement on the feeding side for the woof yarn, which side consists essentially of the prewinding device, the woof yarn tension device, the woof yarn monitor and the woof yarn presenting device, the woof yarn passing through these devices before the feeding by a corresponding feeding element into the weaving shed. For the alternate feeding of different woof yarns, this arrangement is present several times. The woof yarn tension device, the woof yarn monitor and the woof yarn presenting device have together, as a rule, several deflecting points in the form of yarn guide eyes, through which the woof yarn travels, although at small deviation angles. At the high speeds of the weaving machines customary today, this results in increased friction and therefore a higher stressing of the woof yarn at each deflection point.

For reducing the stressing of the yarn, a device is known from German Patent Document DE 195 35 895 C1 which provides only one common woof yarn monitor for a plurality of woof yarn types to be fed, which woof yarn monitor is brought in contact with the woof yarn to be fed only for a certain time period during the feeding of the woof. Although the described device reduces the duration of the contact between the woof yarn and the woof yarn monitor, it requires high constructive expenditures and, on the whole, does not result in a reduction of the required deflection points.

European Patent Document EP 0 634 509 A1 discloses a woof yarn tension device which is followed by a yarn tension sensor whose measuring values are used for controlling the tensioning force of the woof yarn tension device. As the result, the tensioning force can be optimally adjusted during each woof feeding, which, among other things, reduces the stressing of the woof yarn. This device also has the disadvantage that a total of at least three yarn guide eyes are required and the yarn tension sensor has additional deflection points for the mechanical sensing of force, whereby the overall stressing of the woof yarn is increased further.

From European Patent Document EP 0 333 302 A1, it is known to arrange, in a woof yarn feeding system of a gripper weaving machine, a separate monitor for the woof yarn behind the woof yarn tension devices (tandem tension devices) in the woof feeding direction. For the plurality of the woof yarns travelling through the woof monitor, the corresponding woof monitor represents a deflection point, although at a small angle. This deflection results in friction and therefore in an undesirable stressing of the yarn.

It is an object of the invention to further develop a woof yarn tension device with a yarn guide eye on the output side such that the stressing of the woof yarn can be reduced.

According to the invention, this object is achieved by providing a woof yarn tension device for weaving machines, consisting of a controllable tension device which acts upon the woof yarn and which, at least on the output side, has a yarn guide eye, characterized in that the yarn guide eye is constructed as a woof yarn monitor.

The invention is based on the fact that the output-side yarn guide eye of the woof yarn tension device is constructed as a woof yarn monitor.

This results in the important advantage that an additional woof yarn monitor on the output side of the woof yarn tension device can be eliminated, whereby at least one deflection point is eliminated. The reduction of the total number of deflection points results in a lower stressing of the yarn.

Another advantage of the combination of the woof yarn tension device and the woof yarn monitor according to the invention consists of the compact construction and simplified mounting and adjusting of the arrangement on the weaving machine. The type of the used tension device plays no role that would be essential to the invention. According to the invention, all types of the initially mentioned woof yarn tension devices or other types can be equipped with an integrated woof yarn monitor.

Advantageous features and further developments of the invention are described herein and in the claims.

The woof yarn monitor is preferably constructed as a piezo-electric sensor which is integrated in the output-side guide eye of the woof yarn tension device. However, in a known manner, the woof yarn monitor may also contain an electro-mechanical sensor, an electro-optical sensor, a capacitive or an inductive sensor.

The integrated woof yarn monitor can advantageously be constructed as a yarn tension sensor whose output signal is returned to the woof yarn tension device for controlling the tensioning force.

A woof yarn tension device is assigned to one used woof yarn type or one used woof yarn color respectively.

Other objects, advantages and novel features of the present invention will become apparent from the following detailed description of the invention when considered in conjunction with the accompanying drawings.

BRIEF DESCRIPTION OF THE DRAWING

The single drawing FIGURE is a lateral view of a woof yarn tension device constructed according to a preferred embodiment of the present invention.

DETAILED DESCRIPTION OF THE DRAWING

The tension device comprises two lamella-type spring steel sheets 4, 5 which are resiliently disposed with respect to one another and receive the woof yarn 13 travelling through between one another. Both spring steel sheets 4, 5 are fastened by means of a spring steel sheet fastening device 10 on one side on a base plate which, in turn, is fastened by means of a holding device 3 on the weaving machine body. The more the spring steel plates 4, 5 are pressed against one another, the higher the tensioning force exercised on the woof yarn 13. In the illustrated embodiment, the rearward spring steel plate 4 is firmly fastened on the base plate 2, while the forward spring steel plate 5 is acted upon by an eccentric 8. According to the rotating position of the eccentric 8, the forward spring steel plate 5 is pressed with lower or higher force against the rearward spring steel plate 4. The eccentric 8 is actuated by an eccentric drive 9 fastened on the base plate 2, the eccentric drive 9 being controlled by an electronic control system 11. The electronic system 11 is also arranged on the base plate 2 and is connected with the weaving machine control by way of a connection 12.

On the input side, the woof yarn tension device 1 has an inlet yarn guide 6 which guides the woof yarn 13 between the spring steel plates 4, 5. On the output-side end of the spring steel plates 4, 5, an outlet yarn guide is arranged which, according to the invention, is constructed as a woof yarn monitor 7. The woof yarn monitor 7 consists of a yarn guide eye which contains a suitable sensor which detects the presence of the woof yarn and/or is used for measuring the yarn tension forces. As the result of the integration according to the invention of the woof yarn monitor 7 in the woof yarn tension device 1, a separate woof yarn monitor connected on the output side can be eliminated. As the result, the stressing of the woof yarn as a whole is reduced.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A weaving machine assembly comprising:

a controllable woof yarn tensioning device, a yarn guide eye at an output side of the woof yarn tensioning device, and a woof yarn tension sensor means incorporated in the yarn guide eye and operable to monitor the woof yarn tension at an outlet side of the tensioning device.

2. A weaving machine assembly according to claim 1, wherein the tension sensor means comprises a piezo-elelectrical sensor.

3. A weaving machine assembly according to claim 1, wherein the tension sensor means comprises an electro-mechanical sensor.

4. A weaving machine assembly according to claim 1, wherein the tension sensor means comprises an electro-optical sensor.

5. A weaving machine assembly according to claim 1, wherein the tension sensor means comprises a capacitive sensor.

6. A weaving machine assembly according to claim 1, wherein the tension sensor means comprises an inductive sensor.

7. A weaving machine assembly according to claim 1, wherein a plurality of said yarn tensioning devices are provided, along with a corresponding plurality of yarn guide eyes and woof yarn tension sensor means, operable to accommodate a corresponding number of woof yarn types and colors.

8. A weaving machine assembly according to claim 1, further comprising a control system for utilizing signals from the woof yarn tension sensor means to control tension applied to the woof yarn at the respective woof yarn tensioning device.

9. Method of controlling woof yarn tension in a woof yarn tension device for a weaving machine, of the type comprising a controllable tension device which acts upon the woof yarn and which has a yarn guide eye at an output side of the tension device, a yarn tension sensor means being incorporated in the yarn guide eye and operable to monitor the woof yarn tension of the woof yarn passing therethrough, said method comprising utilizing an output signal of the woof yarn tension sensor means to control tension of the tensioning device.

* * * * *